United States Patent [19]

Nagayoshi

[11] 4,036,702

[45] July 19, 1977

[54] COKE OVEN SEALING APPARATUS

[76] Inventor: Konno Nagayoshi, No. 29-11, 3-chome, Takanodai, Nerima, Tokyo, Japan

[21] Appl. No.: 701,115

[22] Filed: June 30, 1976

[51] Int. Cl.[2] ..... C10B 1/06; C10B 25/06

[52] U.S. Cl. ..... 202/248; 110/173 R

[58] Field of Search ..... 202/242, 247, 248, 250, 202/269; 110/173; 49/505

[56] References Cited

U.S. PATENT DOCUMENTS

| | | | |
|---|---|---|---|
| 1,745,390 | 2/1930 | Wilputte | 202/248 |
| 2,007,318 | 7/1935 | Wilhelm | 202/248 |
| 2,478,215 | 8/1949 | VanAckeren | 202/248 |
| 2,780,590 | 2/1957 | Doll | 202/248 |
| 3,974,038 | 8/1976 | Tucker | 202/248 |

FOREIGN PATENT DOCUMENTS

| | | | |
|---|---|---|---|
| 974,391 | 12/1960 | Germany | 202/248 |

*Primary Examiner*—Joseph Scovronek
*Assistant Examiner*—Roger F. Phillips
*Attorney, Agent, or Firm*—McGlew and Tuttle

[57] ABSTRACT

An improved coke oven sealing apparatus which is adapted to constantly maintain secure contact of the door with the door sealing frame. With respect to the door sealing frame, it is adjustably constructed so as to maintain its outer surface for receiving knife edge constantly vertical. While the door is constructed so that it may not be subjected to thermal bend, the knife edge can be effectively held and adjusted by spring units; and the holding rods are mounted through bracket at regular intervals on the outer side of the side walls of the metallic door body. The knife edge is made broader and thinner than conventional ones.

8 Claims, 25 Drawing Figures

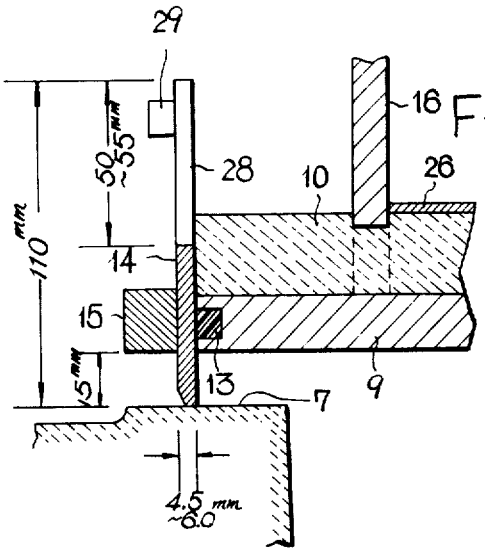
Fig22
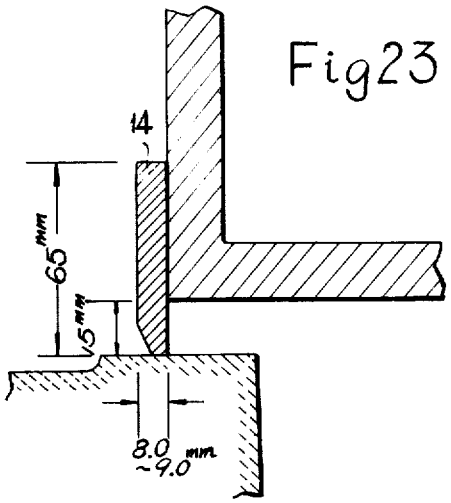
Fig23
Fig24
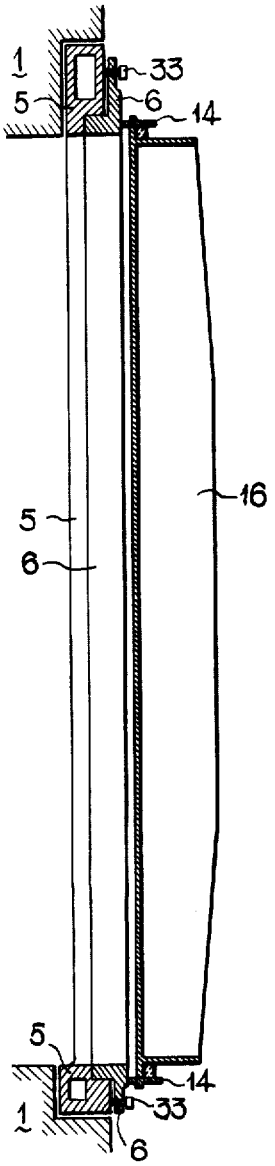
Fig25
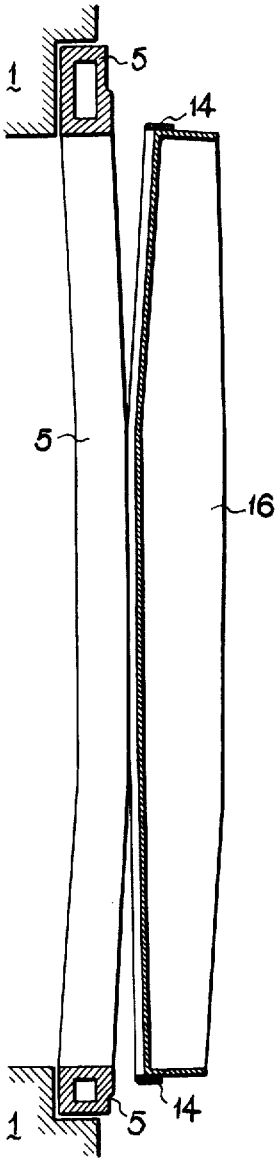

COKE OVEN SEALING APPARATUS

CROSS REFERENCE TO RELATED APPLICATIONS

An application Ser. No. 677,965, filed Apr. 19, 1976 by me contains a detailed description of a coke oven door similar to one discussed in connection with this application.

BACKGROUND OF THE INVENTION

This invention relates to an improved coke oven sealing apparatus, more particular to a door fitted to an opening on the pusher side or coke side of a coking chamber of a coke battery; and a door sealing frame mounted on the periphery of the opening end for receiving said door.

SUMMARY OF THE INVENTION

The object of this invention is to provide a coke oven sealing apparatus for constantly maintaining secure contact of the door with the door sealing frame when closed. The improvement resides in both the door and the door sealing frame with respect to the door sealing frame, it is adjustably constructed so as to maintain its outer surface for receiving door's knife edge seal constantly vertical. With respect to the door, it is constructed so that it is subjected to little if any thermal bend so that the knife edge seal can be effectively held against the door's metallic body and adjusted to move to and fro through separate devices in place of conventional single adjustment device without causing gas leakage. Thus, the entire peripheral end of the knife edge seal constantly contacts perpendicularly with the outer surface of the door sealing frame without any gaps in order that secure prevention of gas and tars leakages can be achieved.

This invention is particularly characterized in that the door sealing frame mounted about the periphery of the opening of a coking chamber is divided into an inner and outer frame in constant contact with each other at their opposite engaging faces in order to hold the outer surface of the outer frame, for receiving the door knife edge, in continuously vertical condition. The base plate of the metallic door body is covered by both inner and outer adiabatic members and the entire periphery groove thereof is filled with adiabatic member such as asbestos. A frame-like knife edge is located around the periphery end of the base plate and is adjustably held both by spring unit and holding rods mounted at regular intervals through brackets on the outer side of the side walls of the metallic door body. The knife edge is formed with U-shaped slots at regular intervals opening outwards, with pairs of projections located on outer surface and aside said U-shaped slot and with hooped projections having blind holes at regular intervals. Both the spring units and the holding rods are constructed so as to adjustably depress the knife edge at the latter's outer end and hooped projection respectively, thereby enabling the knife edge to be adjusted for constant close contact with the door sealing frame when the door is closed without causing any gas and tars leakages.

The coke oven door and the door sealing frame have inner and outer surfaces which are directly subjected to high coke oven heat or are exposed to low ambient air, respectively, and this results in their self-distortion due to temperature difference therebetween. The door is apt to bend backward in such a manner that both the upper and lower ends expand outwards, while the door sealing frame is apt to bend inwards in such a manner that the center portion thereof expands outwards due to the oven's expansion and other factor.

In accordance with the present invention, the outer frame of the door sealing frame is provided with an adjustment device to shift it to and fro in order that the outer surface of the outer frame receive the knife edge and to maintain the same vertical. The door is constructed in such manner that the base plate of the metallic door body is covered on both sides by adiabatic members to minimize the difference of thermal expansions on the inner and outer faces of the base plate and to secure equal expansions therein. This construction also permits slow conduction of the inner heat to the side walls of the metallic door body with the result that the door distortion is minimized even if used for a long period of time.

While the door knife edge seal has been heretofore held and adjusted by single device, the spring units and the holding rods in accordance with the present invention separately function as such device. This enables the door knife edge seal to be smoothly adjusted to move to and fro without inclination when moved and serves, in cooperation with the vertical adjustment device of the door sealing frame, to achieve complete prevention of gas and tars leakages from the contacting surfaces of the door sealing frame with the knife edge.

Further, the present invention includes a sealing member to completely seal the engaging faces with the knife edge seal to prohibit the eventual gas leakage.

This invention enables the knife edge seal to be made thiner than the conventional ones, e.g. from 8–9mm to 4.5–6.0mm, since they employed separate devices for adjusting and holding of the knife edge seal in place. Consequently, the breadth of the knife edge is allowed to increase without losing its flexibility from conventional 65mm to present 110mm. This enables the adjustable margin of the knife edge seal to increase as much as two folds, viz., from conventional 15–16mm to present 35mm or more.

Mounting U-shaped slots of 50–55mm in length on the outer side of the knife edge at suitable intervals enables adjustment of the upper and lower portions of the knife edge seal to be smoothly made due to flexibility increased thereby.

Such adiabatic construction of the door as employed in this invention further serves to remarkably reduce the thermal conduction from the coking chamber with the result of increasing the thermal efficiency and thus manufacturing the high quality coke.

BRIEF DESCRIPTION OF THE DRAWING

This invention will be illustrated in detail by way of examples in the accompanying drawings, in which:

FIG. 22 is an explanatory view showing the dimensions and contour of the knife edge of this invention as well as the state it is initially put on the door sealing frame;

FIG. 23 is a similar view in the conventional design;

FIG. 24 is a vertical sectional view showing a relation between both the door and the door sealing frame of this invention;

FIG. 25 is a similar view of the conventional designs.

PREFERRED EMBODIMENT OF THE INVENTION

Figure 1:
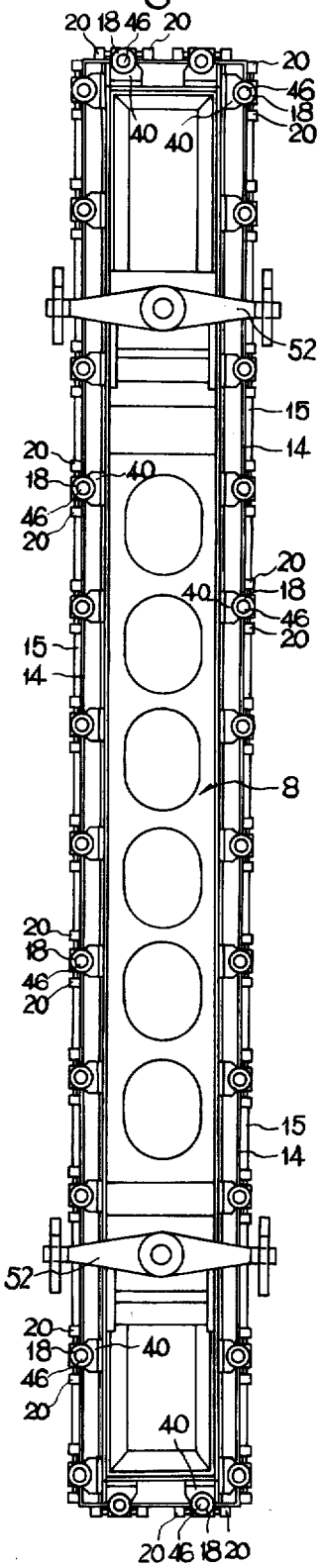
FIG. 1 is a front view of the door in accordance with one embodiment of the present invention.
Figure 2:
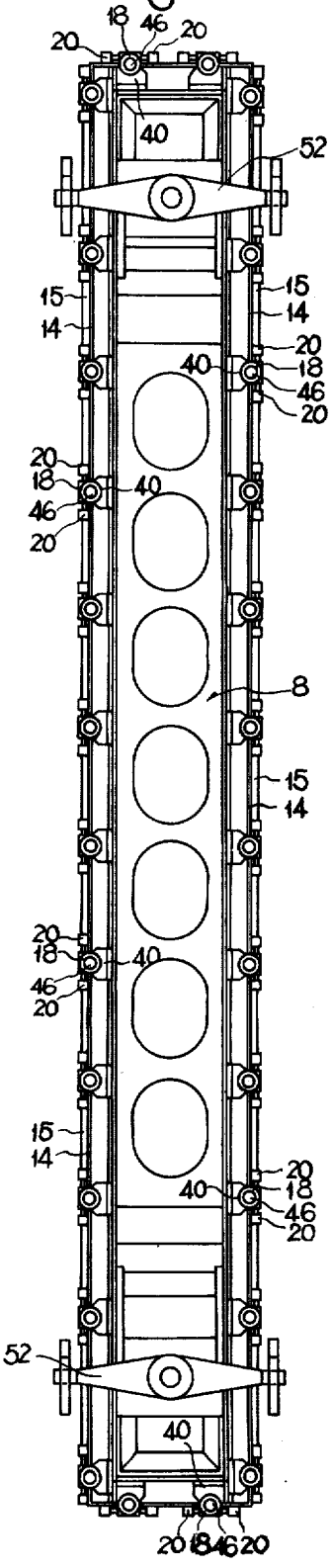
FIG. 2 is a front view of a door in another embodiment of the invention; each latch bar thereof being mounted at a portion upper and lower than that in FIG. 1.
Figure 3:
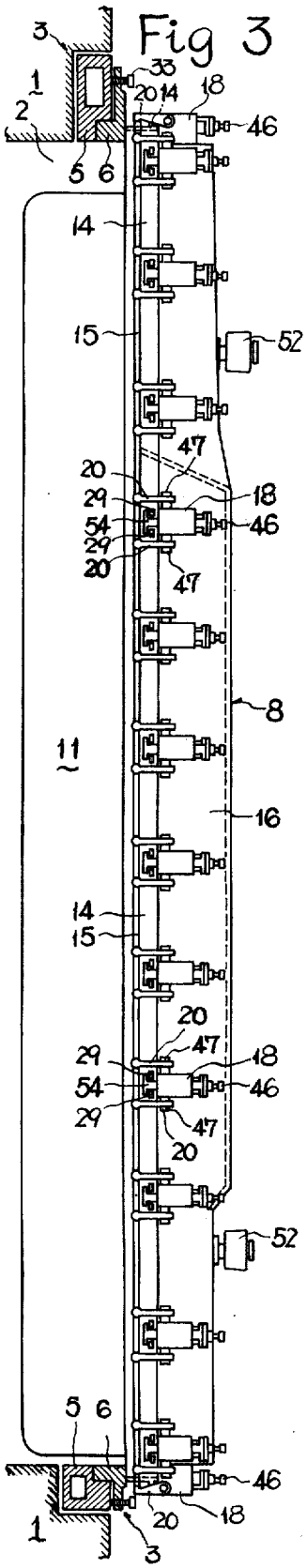
FIG. 3 is a side view of the door of FIG. 1, partly shown in section.
Figure 4:
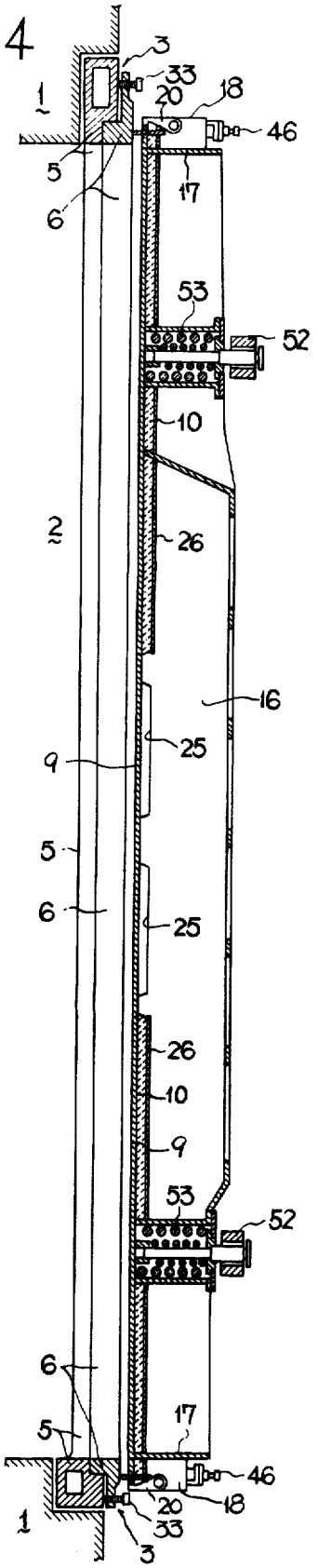
FIG. 4 is a vertical sectional view of the door of FIG. 1.
Figure 5:
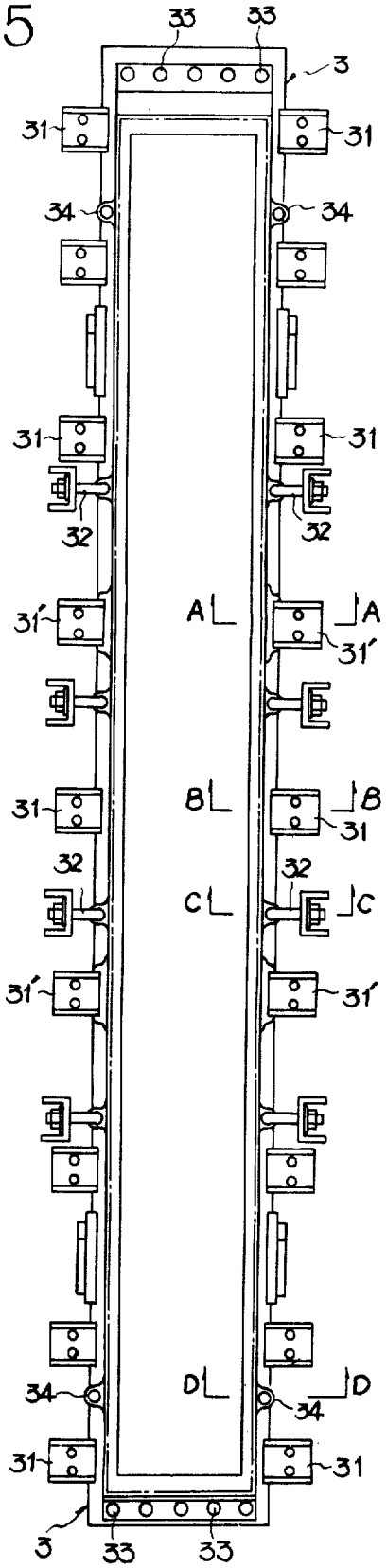
FIG. 5 is a front view of a door sealing frame.
Figure 8:
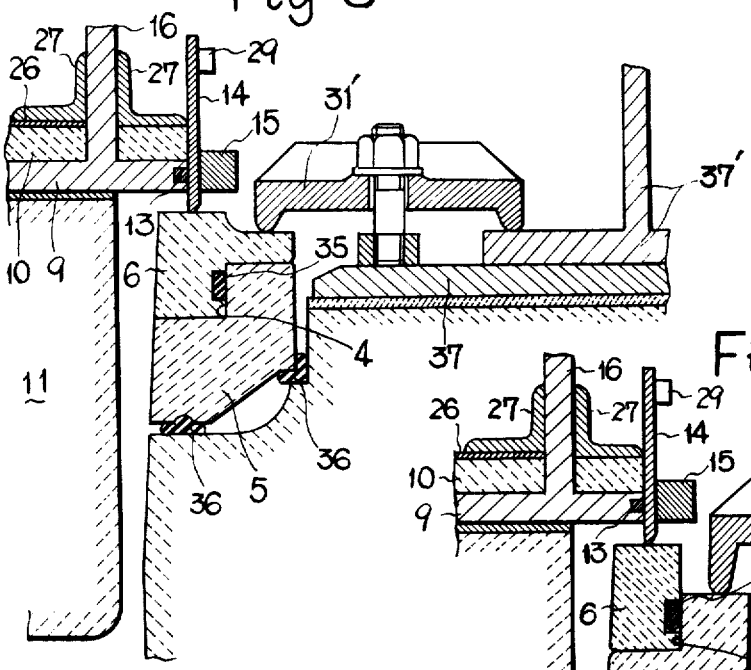
FIG. 8 is an enlarged sectional view taken along the line A—A in FIG. 5.
Figure 9:
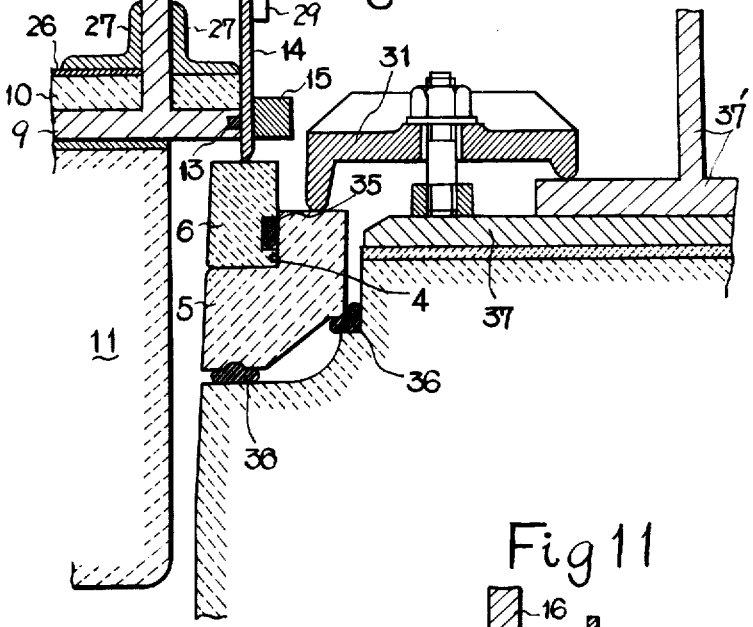
FIG. 9 is a similar view taken along the line B—B in FIG. 5.
Figure 10:
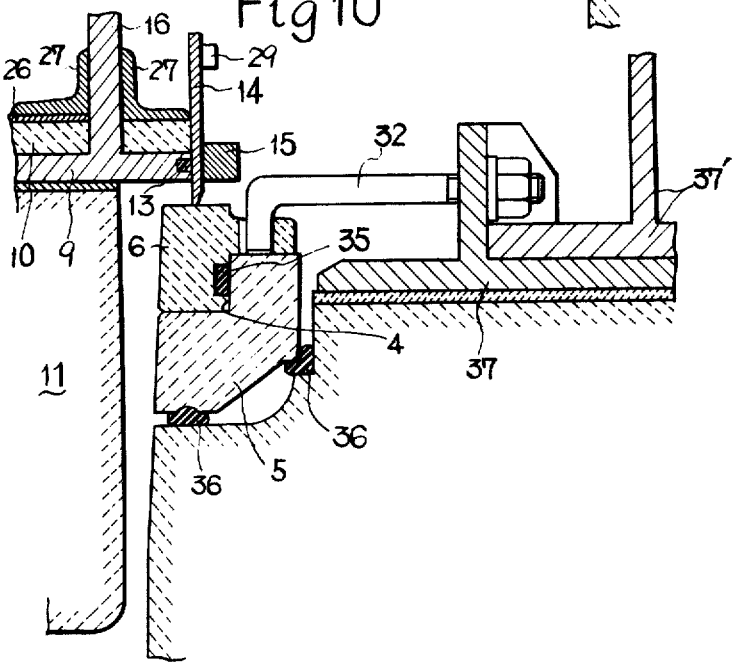
FIG. 10 is a similar view taken along the line C—C in FIG. 5.
Figure 11:
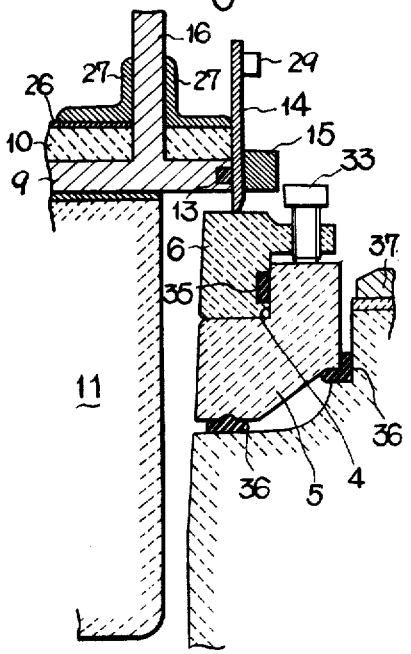
FIG. 11 is a similar view taken along the line D—D in FIG. 5.
Figure 12:
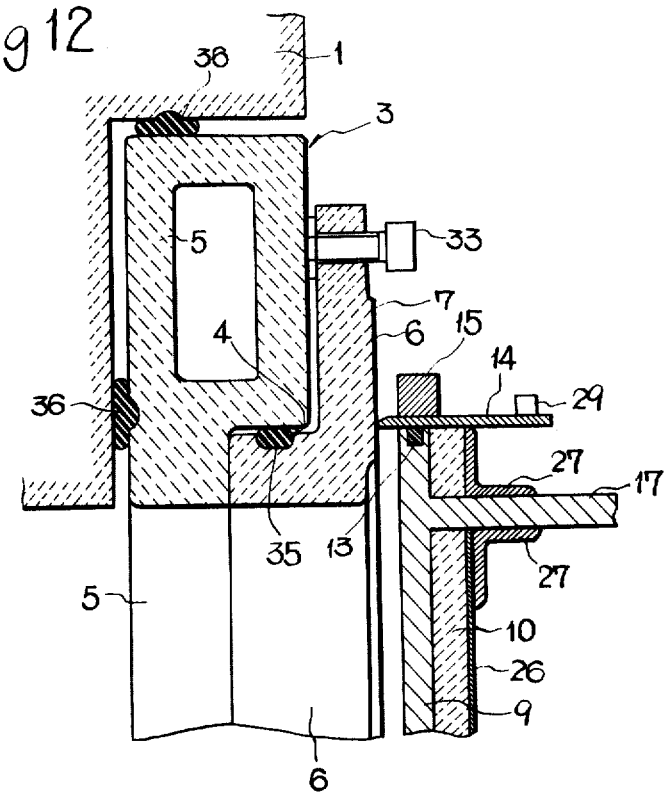
FIG. 12 is an enlarged vertical sectional view of the upper portion of FIG. 4.
Figure 13:
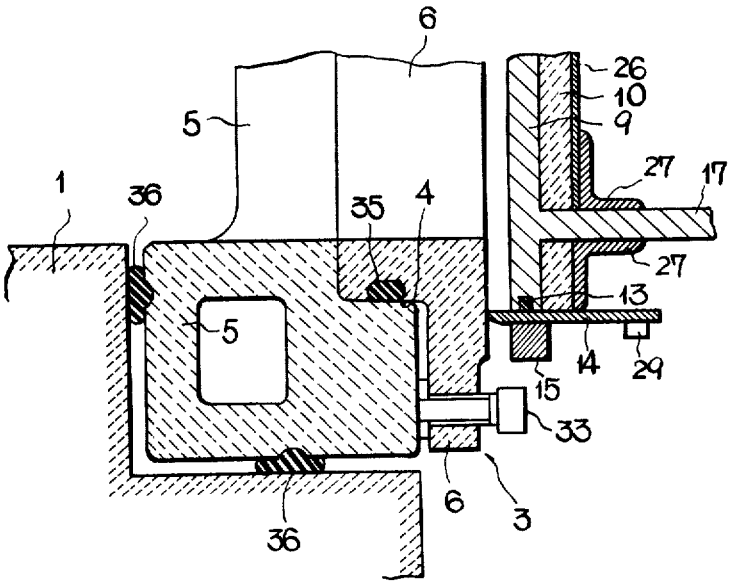
FIG. 13 is an enlarged vertical sectional view of the lower portion of FIG. 4.

Referring to the drawings, particularly to FIGS. 3 and 4, there is illustrated a door sealing frame 3 mounted on the periphery of an opening end of a coking chamber 2 of a coke oven battery 1. As shown in, for example FIGS. 6 and 7, the door sealing frame 3 comprises an inner frame 5 and an outer frame 6 which constantly contact with each other at their opposite engaging faces 4. The door sealing frame 3 is, as shown in FIGS. 5, 8 and 9, mounted on the periphery of the coke chamber opening with a number of clamps 31 and 31'. Of these, clamps 31 press down the inner frame 5 alone, while the clamps 31' locating at the central sides press down both the inner and outer frames 5 and 6. The upper and lower portions of the door sealing frame 3 are depressed down by the clamps 31 and are adjustable to be moved to and fro. As shown in FIGS. 5 and 10, there are arranged, on the both sides of the opening, several drawbars 32 which serve to draw the outer frame 6 and the inner frame 5 simultaneously sidewards. This can prevent both the inner and outer frames 5 and 6 from expanding toward the coking chamber 2. On the upper and lower ends of the outer frame 6 are provided adjustment screws 33 for adjusting the outer frame 6 to and fro. Also provided on both upper and lower sides of the outer frame 6 are supplemental adjustment screws 34. In FIGS. 6–13, there are placed sealing members 35 and 36 respectively between the inner frame 5 and the outer frame 6 and between the inner frame 5 and the periphery of the opening of the coke oven. The sealing member 35 placed between the engaging feces 4 of the inner and outer frames 5 and 6 serves to prevent gas leakage even when the outer frame 6 is adjusted to move to and fro.

In FIGS. 8–10, there are shown flashing plate 37 for fitting the clamps 31, 31 and the drawbars 32 thereon. Reference numeral 37' denotes backstays therefor.

Figure 6:
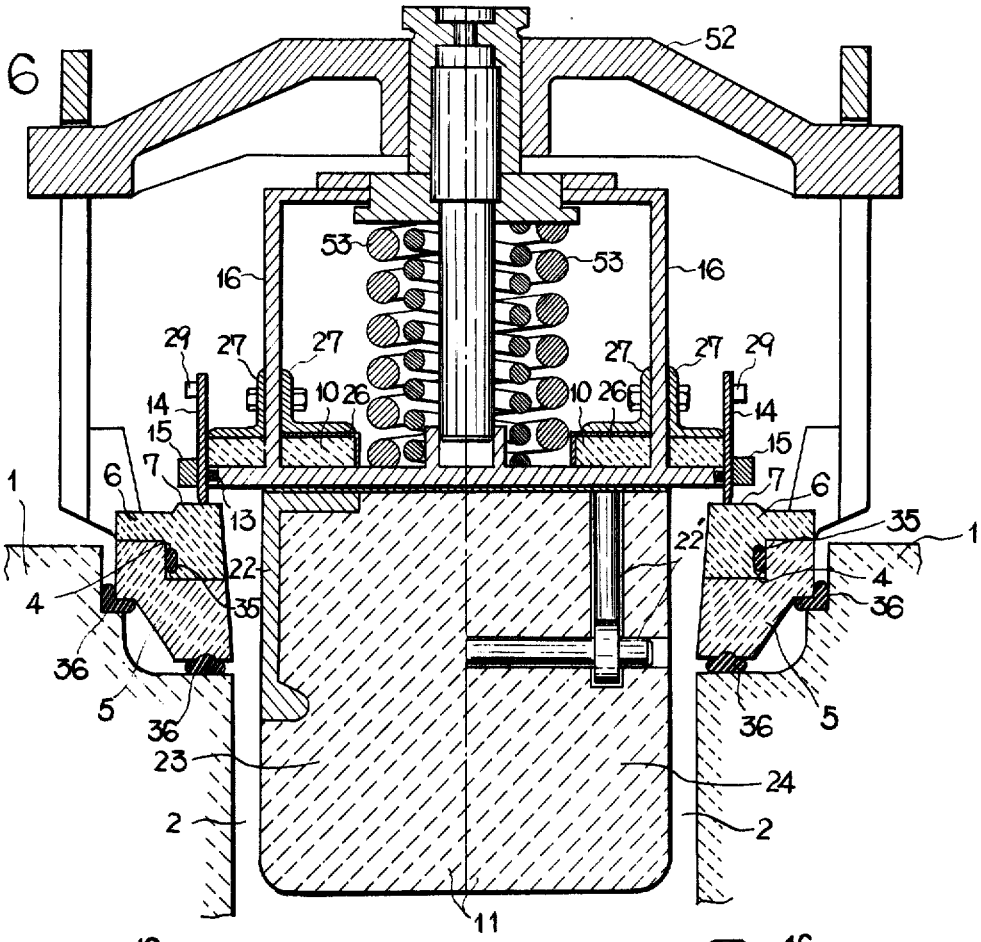
FIG. 6 is a cross-sectional view of the door taken along the latch bar portion.
Figure 7:
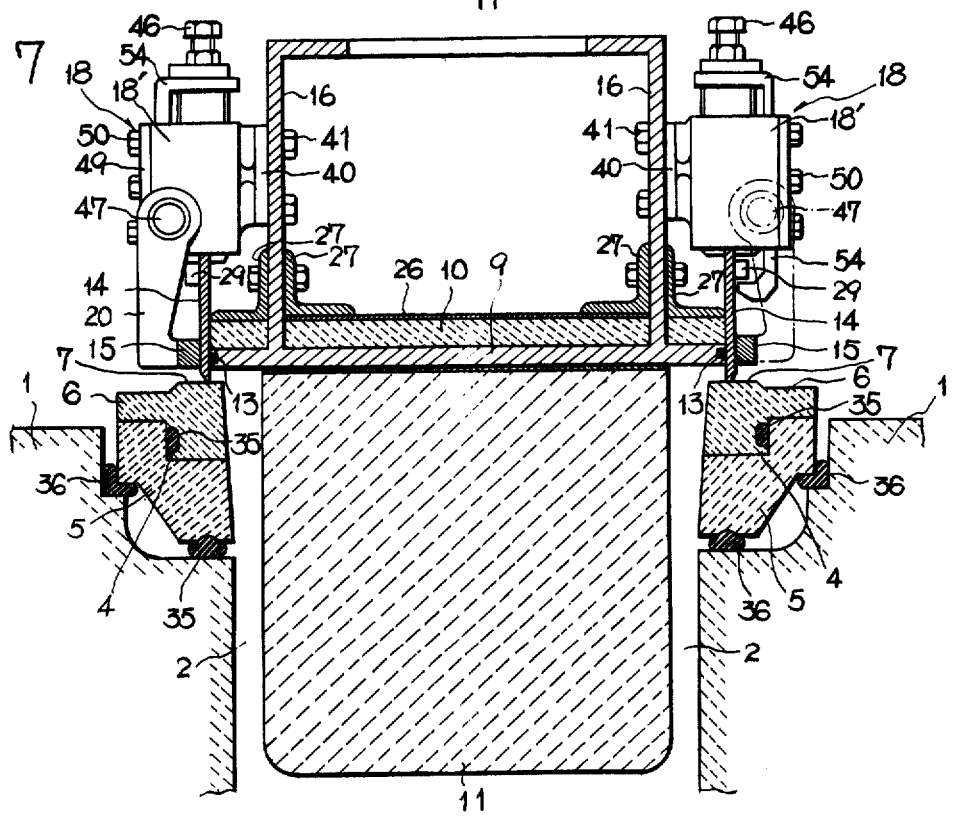
FIG. 7 is a cross-sectional view of the door taken along another portion.

The coke oven door 8 includes, alike a conventional one and as shown in FIGS. 6 and 7, a metallic body with upper and lower latch bars 52, compression springs 53, an adiabatic door plug 11 and a frame-like knife edge 14. Inner surface of a base plate 9 of the metallic body is fixed to the adiabatic door plug 11. In FIGS. 6 and 7, there are shown a firebrick 23 as the adiabatic door plug 11 in the left side and a silica brick 24 in the right. The firebrick 23 is held by a bridge holder 22 and the silica brick 24 is fixed by a couple of fitting means 22'. However, the kind of adiabatic members is not a critical feature of this invention and so any type can be used as the adiabatic door plug. Outer surface of the base plate 9 of the metallic body is provided with an adiabatic member 10. The adiabatic member 10 is covered by a guard plate 26 and fastened by angles 27 to the base plate 9.

Figure 18:
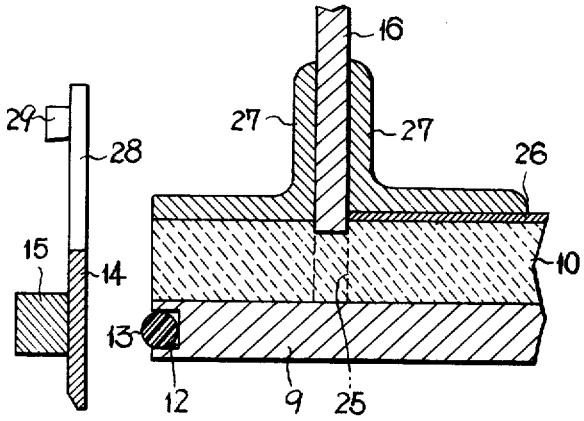
FIG. 18 is an enlarged view of a portion of FIGS. 6 and others, the knife edge being shown separately from the base plate of the metallic body.
Figure 19:
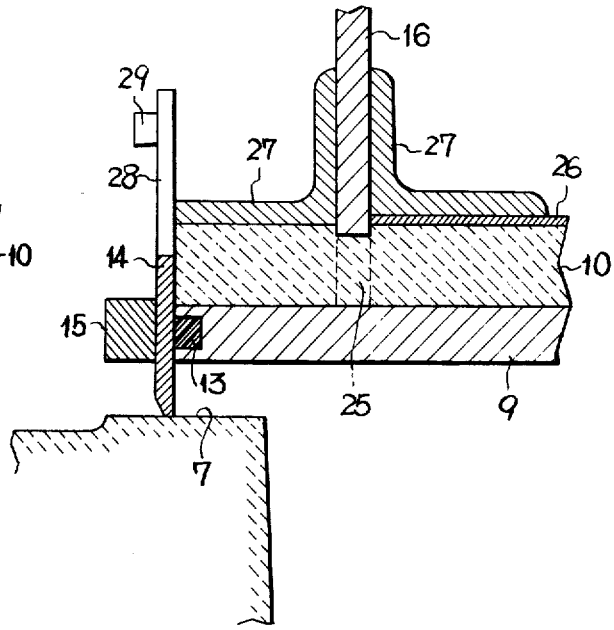
FIG. 19 is a similar view as above, but the knife edge being shown attached to the base plate.
Figure 20:
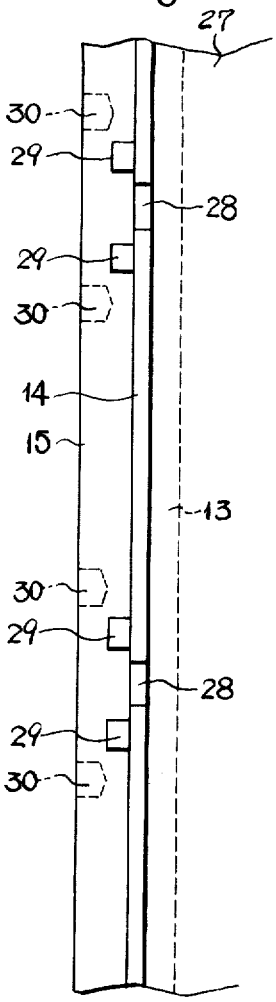
FIG. 20 is an enlarged sectional view showing the knife edge with a hooped projection and pairs of detent projections.

As shown in FIGS. 18 and 19, side walls 16 of the metallic body are formed at their lower ends and at some intervals with vertically elongated holes 25 which are filled with the adiabatic member 10. On the entire periphery of the base plate 9 is formed a slot 12 where a sealing member 13 of a suitable thickness made of asbestos or the like adiabatic material is inserted. To the outside of the periphery of the base plate 9 is mounted the frame-like knife edge 14. The knife edge 14 employed is, as shown in FIG. 22, of thickness of 4.5–6.0mm, breadth of 110mm, initial protrusion from the base plate of 15mm and maximum adjustable margin of 35mm. The knife edge 14 is formed at regular interval with U-shaped slots 28 of 55mm in length from the outer end. On both sides of the outer surface of the slots 28 are formed a pair of projections 29. A hooped projection or boss 15 of cross-sectionally square shape is formed on the outer surface of the knife 14, oppositely to the periphery of the base plate 9.

Figure 14:
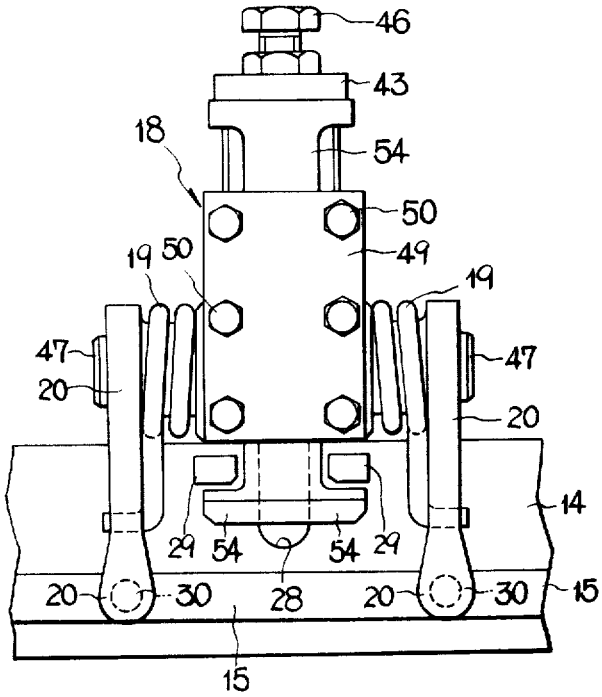
FIG. 14 is an enlarged view of a spring unit and others made of FIG. 3.
Figure 15:
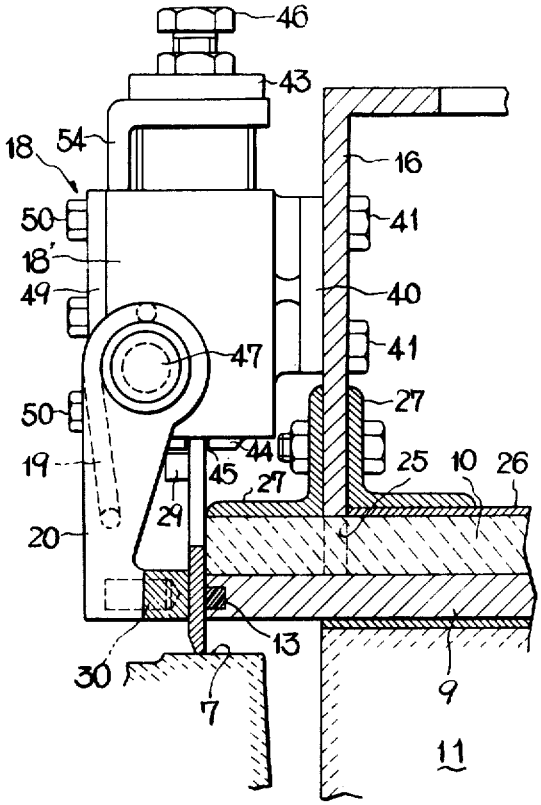
FIG. 15 is an enlarged side view of a portion of FIG. 7.
Figure 16:
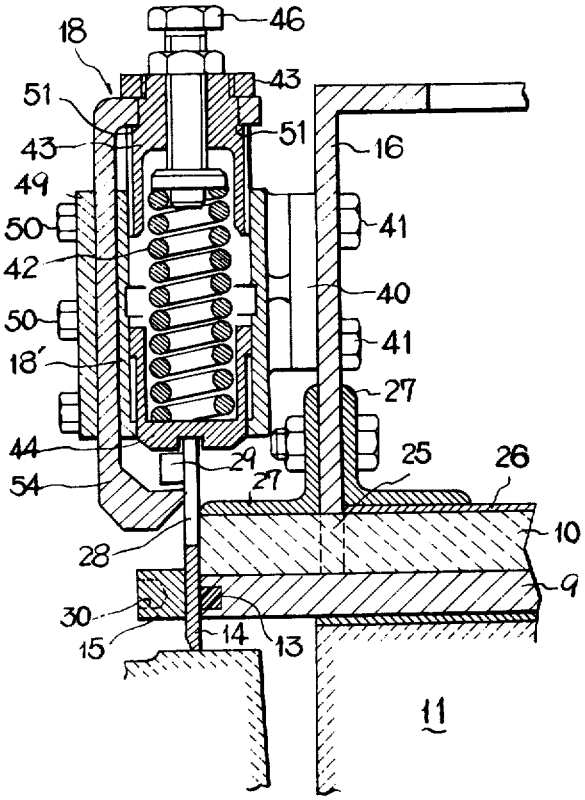
FIG. 16 is a vertical sectional view of the above FIG. 15.

As shown in FIGS. 14, 15 and 16, there are formed at regular intervals on the outer surface of the hooped projection or boss 15 blind holes 30 for reception of holding rods 20 described later on. In FIGS. 7, 15, 16 and 17, there is shown a bracket 40 fastened at regular intervals to the outer side of the side wall 16 and the upper and lower walls 17 (not shown) by means of nuts 41. As will be seen from FIG. 16, the bracket 40 carries a sleeve 18 wherein a spring unit 18' is inserted. A coil spring 42 is inserted in the spring unit 18' between an adjusting collar 43 and a knife edge depressor 44. The depressor 44 is formed at its lower end with a groove 45 where outer end of the knife edge 14 engages therewith to depress the knife edge 14 toward the door sealing frame. A spring pressure adjusting rod 46 is movably threaded through the adjusting collar 43.

Figure 17:
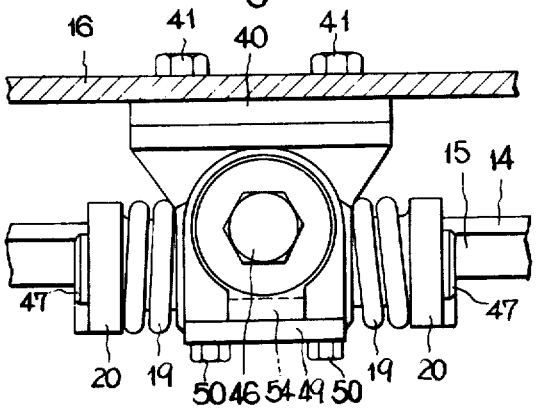
FIG. 17 is a plan view of the above FIG. 15.

As shown in FIGS. 14 and 17, a pair of arms 47 are provided on both sides of the spring unit 18' and the holding rods 20 are suspended from both ends of the arms 47. The holding rods 20 are energized by coil spring 19 to swing towards the knife edge 14 and thus the lower ends thereof which are bent inwards are forced securely to engage with the blind holes 30 of the hooped projection 15. There is formed on the outer side of the spring unit 18' a vertical groove wherein a hook lever 54 for holding the knife edge 14 is inserted. The hook lever 54 is prevented from slipping out the groove by a cover plate 49 which is fastened to the spring unit 18' with bolts 50. The upper portion of the hook lever 54 is squarely bent inward and the portion thus bent is in the form of a ring which in turn is put on the step face 51 of the adjusting collar 43 and freely encircles the upper end thereof. Lower end of the hook lever 54 is bent inward to form a hook which serves to engage with the pair of projections 29.

Figure 21:
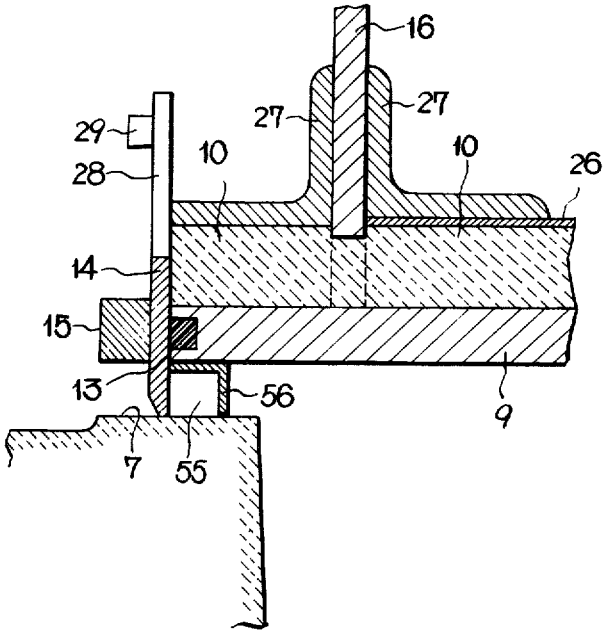
FIG. 21 is a similar view as above FIGS. 18 and 19 with exception of a steam passage mounted in the lower portion of the knife edge seal.

Further, as shown in FIG. 21, the knife edge 14 is provided on the lower end portion with an inwardly extending L-shaped frame 56 which constitutes together with the lower end of the knife edge 14 and the upper surface 7 of the door sealing frame a steam passage 55 of cross-sectionally square shape when the door is closed. The steam passage 55 serves to prevent adherence of tars to the knife edge 14 and also to effectively prevent gas leakage by passing suitable amount of steams therethrough and thus forming steam layer or steam curtain there.

Since the door 8 is constructed as above described with its base plate 9 covered by both adiabatic members 10 and 11, there is not caused any difference between thermal expansions of both the inner and outer surfaces thereof and thermal conduction from the oven chamber to the side walls 16 is reduced or eliminated. This results in prevention of the door's bend. Further, since there are placed between the knife edge 14 and the periphery of the base plate 9 the compressed sealing members 13, gas leakage from therebetween can be completely eliminated.

Mounting the knife edge adjustment members separately from the holding rods 20 whose lower ends engage with the hooped projections of the knife edge enables the knife edge to be smoothly adjusted to move to and fro. Accordingly, the entire periphery end of the knife edge can contact, in cooperation with the adjusting device of the door sealing frame, to the outer surface 7 of the door sealing frame without leaving any gaps therebetween when the door is closed.

Further more, since the hooped projection is formed on the outer surface of the knife edge 14, the knife edge itself can be made remarkably thiner than conventional ones without causing gas leakage and this enables the knife edge to have 2 folds or more adjustable margin or allowance compared with the conventional ones.

What is claimed is:

1. In a coke oven sealing apparatus the combination of a door and door sealing frame wherein said door includes a base plate having an outer metallic door body and an inner adiabatic door plug connected to said base plate, said outer metallic door body having an outer adiabatic member, said base plate having a groove formed therein, a sealing means disposed in said groove, a knife edge seal fitted in said groove, a spring unit for adjusting said knife edge seal relative to said door frame, said door frame including an inner and outer frame member, and said knife edge seal having spaced U-shaped slots formed therein to add flexibility, and a holding means for holding said knife edge seal against said grooved base plate, the improvement comprising: a pair of projections located on either side of said U-shaped slots on the outer side of said knife edge seal, and a hooped shaped projection having a hole formed thereon on the outer side of said knife edge seal for reception of said holding means, said holding means including a pair of arms mounted to either side of said spring unit, a coil spring for biasing each of said arms toward said knife edge seal, said arms having an inwardly bent lower end to engage in the hole of said looped projection, said spring unit including a hook lever, said hook lever having a lower end hook for engaging said pair of projections on said knife edge seal, a first clamp means for the adjustable pressing of the inner frame member only against the coke oven, a second clamp means for adjustable pressing both the inner and outer frame member against the coke oven, and drawbars disposed on opposite sides of said door frame to draw said inner and outer frame members laterally.

2. In a coke oven, a door closure comprising a door frame adapted to circumscribe a coke oven opening, said door frame including an inner frame member and an outer frame member disposed in contiguous relationship about said opening, sealing means interposed between said inner and outer frame members and between said inner frame member and said coke oven, means for adjustable securing said inner and outer frame members about said opening whereby portions of said inner frame member can be independently adjusted relative to said outer door member, a door for closing said opening, said door including a base plate, a door body connected to one side of said base plate, an adiabatic plug connected to the other side of said base plate, an adiabatic layer interposed between said door body and said base plate, said base plate having a circumscribing groove formed in an edge portion thereof, a knife edge seal mounted in said groove, said knife edge seal having spaced U-shaped slots formed therein, projections connected to said knife edge seal to either side of said slots, a boss having a hole formed therein connected to said knife edge seal, and means for adjustably biasing said knife edge seal into sealing relationship, said latter means including a spring unit having a hook lever for engaging said projections, a spring for biasing said hook lever, means for adjusting said spring to vary the spring bias thereof, and holding rods connected to said spring unit for exerting a lateral force on said knife edge seal.

3. The invention as defined in claim 2, wherein said holding rods include an inwardly bent end portion adapted to be received in the hole formed in said boss, and a spring operating on said holding rod for maintaining said inwardly bent end portion in engagement in said hole.

4. The invention as defined in claim 2, wherein said means for adjustably receiving the inner and outer door frames includes a first clamping means operating on said inner frame member only, and a second clamping means operating on both said inner and outer frame members.

5. The invention as defined in claim 4, and including drawbar means disposed to either side of said door frame, said drawbar engaging said frame member to exert a lateral force thereon.

6. The invention as defined in claim 2, and including means defining a steam passageway circumscribing said knife edge seal to prohibit the adherence of coke tars against said knife edge seal and to prohibit gas leakage thereat.

7. The invention as defined in claim 2, and including adjusting means for adjusting the outer door frame relative to the inner door frame.

8. The invention as defined in claim 7, wherein said adjusting means comprise a plurality of adjusting screws circumferentially spaced about said outer frame member.

* * * * *